US006125584A

United States Patent [19]

Sanders

[11] Patent Number: 6,125,584

[45] Date of Patent: Oct. 3, 2000

[54] AUTOMATIC DOOR BOTTOM

[75] Inventor: Vernard W. Sanders, Ventura, Calif.

[73] Assignee: Pemko Manufacturing Co., Ventura, Calif.

[21] Appl. No.: 08/365,849

[22] Filed: Dec. 29, 1994

[51] Int. Cl.[7] ..... F06B 7/20

[52] U.S. Cl. ..... 49/312; 49/310

[58] Field of Search ..... 49/303, 306, 307, 49/308, 309, 310, 311, 506; 403/367, 370, 374, 297, 314, 368

[56] References Cited

U.S. PATENT DOCUMENTS

| | | |
|---|---|---|
| 499,629 | 6/1893 | Ellis . |
| 1,054,158 | 2/1913 | Wickstrum . |
| 1,529,424 | 3/1925 | Edwards . |
| 1,646,559 | 10/1927 | Ray et al. . |
| 1,853,338 | 4/1932 | Dennis . |
| 1,948,108 | 2/1934 | Goellner . |
| 1,976,970 | 10/1934 | Spanjers et al. . |
| 2,075,074 | 3/1937 | Wierk, Jr. . |
| 2,282,109 | 5/1942 | Balousek . |
| 2,344,278 | 3/1944 | Balousek . |
| 2,555,192 | 5/1951 | Hopkins . |
| 3,030,674 | 4/1962 | Kapaun et al. . |
| 3,199,155 | 8/1965 | Coleman . |
| 3,250,314 | 5/1966 | Wetzel . |
| 3,374,580 | 3/1968 | Ruff . |
| 3,462,885 | 8/1969 | Miller . |
| 3,496,676 | 2/1970 | Halpern . |
| 3,703,788 | 11/1972 | Rivers . |
| 3,871,133 | 3/1975 | Ellingson, Jr. . |
| 4,406,088 | 9/1983 | Berndt, Jr. . |

OTHER PUBLICATIONS

Hager Barrier Sealing Systems, p. 53Q, No. 730S; p. 54Q, No. 740S; p. 55Q, Nos. 743S, 747S.

National Guard Products, Inc. (1991 Commercial Catalog), p. 38, Nos. 222SN, 225N; p. 39, Nos. 420, 421, 422, 520, 522.

Reese (1991 Catalog), p. 32, Nos. 320,330,521; p. 33; Nos. 370, 372, 430.

Zero International, Inc. (1991 Catalog), p. 14, Nos. 350, 351, 352, 354, 367A; p. 15, Nos. 360, 361, 362, 364, 365, 366.

*Primary Examiner*—Daniel P. Stodola
*Assistant Examiner*—Curtis A Cohen
*Attorney, Agent, or Firm*—Michaelson & Wallace

[57] ABSTRACT

An automatic door bottom for a hinged door which is pivotable to be positioned over a sill when closed, the door having a hinge side and a width, the door bottom having an inverted channel having an open bottom, a length corresponding to the door width and a hinge end corresponding to the hinge side of the door; a sealing member having a length corresponding to the length of the channel, the sealing member being housed in the channel and being movable vertically downwardly into a sealing position in which the sealing member will contact the sill when the door is closed; and a displacement mechanism installed in the channel and coupled to the sealing member for moving the sealing member vertically into the sealing position in response to closing of the door, wherein the displacement mechanism is coupled to the sealing member at a plurality of points along the length of the sealing member and is operative to move the end of the sealing member at the hinge side of the channel into the sealing position prior to the remainder of the sealing member during closing of the door.

27 Claims, 4 Drawing Sheets

AUTOMATIC DOOR BOTTOM

BACKGROUND OF THE INVENTION

1. Technical Field

The present invention relates to a seal or weather strip for a door and more particularly to a door bottom seal which is automatically actuated to seal the gap between a door bottom and its sill as the door is closed and which is automatically retracted when the door is opened.

2. Background Art

Among seals and weather strips which are already known in the art, U.S. Pat. No. 3,703,788 discloses an automatic door bottom for sealing the gap between the bottom of a door and its adjacent sill when the door is closed. The door bottom comprises an inverted U-shaped channel for mounting along the bottom of a door. A flexible sealing element is carried within the channel. Means are provided for reciprocating the sealing element partially out of and back into the channel upon closing and opening the door respectively. The means for reciprocating the sealing element includes a pushrod actuated by bearing against the jamb of the door as the door is closed and spring means for retracting the sealing element when the door is opened.

While the automatic door bottom disclosed in that patent is quite useful and works well to create an effective seal, it may create a certain resistance to closing of the door as it reaches its fully closed position. The flexible sealing element is moved downwardly in a manner such that the end of the element opposite the door hinge may contact the sill before the hinge end. This occurs because the element moves downwardly about an axis of a single pivot pin. Since this contact at the end opposite the hinge end must occur at least slightly before the door reaches its completely closed position, the result will be that the contact between the sealing element and the door sill just before completion of the closing movement will generate the increased resistance to closing. This is an undesirable operating feature and is a source of wear that reduces its useful life.

SUMMARY OF THE INVENTION

It is an object of the present invention to provide an automatic door bottom which avoids the above drawbacks and inconveniences.

A more specific object of the invention is to provide an automatic door bottom which will be moved downwardly to seal the gap between the bottom of a door and its adjacent sill without significantly increasing the force required to move the door to its fully closed position or subjecting the sealing element of the door bottom to excess wear.

Another object of the invention is to impart a movement to the sealing element which prevents the major part of the sealing element from contacting the sill until immediately before completion of closing movement of the door.

A further object of the invention is to provide an automatic door bottom presenting a low operating force.

Another object is to provide means for lengthening the automatic door bottom to accommodate wider doors. This object may be accomplished without increasing the actuating force.

The above and other objects, are achieved, according to the present invention, by an automatic door bottom for a hinged door which is pivotable to be positioned over a sill when closed, the door having a hinge side and a width, the door bottom comprising:

an inverted U-shaped channel having an open bottom, a length corresponding to the door width, and a hinge end corresponding to the hinge side of the door;

a sealing member having a length corresponding to the length of the channel, the sealing member being housed in the channel and being movable vertically downwardly into a sealing position in which the sealing member will contact the sill when the door is closed; and a displacement mechanism installed in the channel and coupled to the sealing member for moving the sealing member vertically into the sealing position in response to closing of the door, wherein the displacement mechanism is coupled to the sealing member at a plurality of points along the length of the sealing member and is operative to move the end of the sealing member at the hinge side of the channel into the sealed position prior to the remainder of the sealing member during closing of the door.

BRIEF DESCRIPTION OF THE DRAWING

The specific nature of the invention, as well as other objects, aspects, uses, and advantages thereof, will clearly appear from the accompanying drawings in which.

DESCRIPTION OF THE PREFERRED EMBODIMENTS

Figure 1:
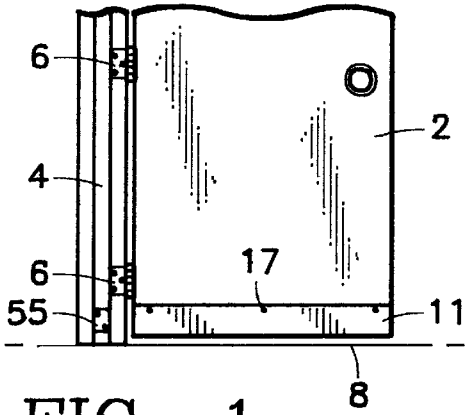
FIG. 1 is a side elevational view showing an automatic door bottom mounted on an open door.
Figure 2:
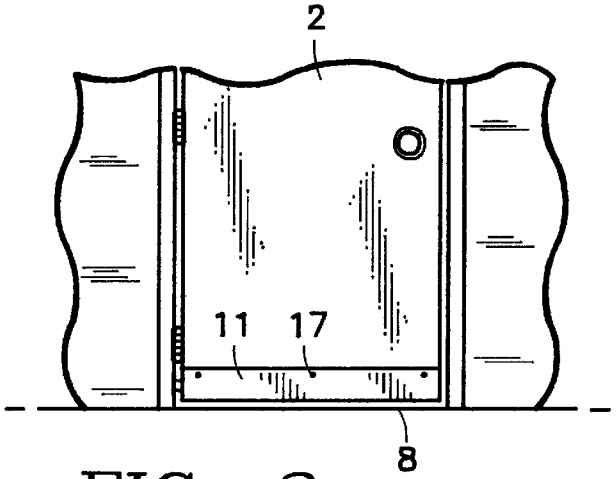
FIG. 2 is a view similar to that of FIG. 1 showing the door in the closed position.

FIGS. 1 and 2 are elevational views showing a door 2 mounted to a door jamb 4 by means of hinges 6. Door 2 is provided with an automatic door bottom 11 according to the invention. The illustrated door bottom is purely exemplary.

The doorway in which door 2 is installed further includes a door sill 8, which could alternatively be a threshold or any suitable floor surface.

Figure 3A:
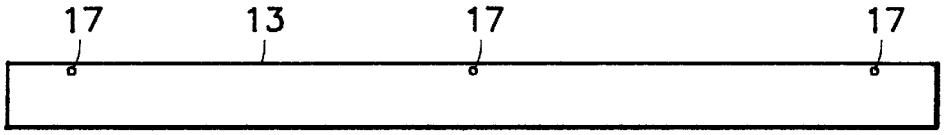
FIG. 3A is a side elevational view of a main channel member of a door bottom according to a first embodiment of the invention.

The door bottom 11 is composed of an extruded metal channel 13, illustrated in FIG. 3A, containing a sealing element and a displacement mechanism. The channel 13 is in the form of an inverted U, or which has a portion in the form of an inverted U, and has a length corresponding to the width of door 2. One advantage of a channel having this form is that it can be mounted on either a door hinged at the left side or a door hinged at the right side without requiring any disassembly and reassembly of the components within the channel member. This is possible because the automatic door bottom of this embodiment is symmetrical about a vertical, longitudinal median plane. For installation at the bottom of door 2 channel 13 is provided with a plurality of aligned holes 17 by means of which channel 13 can be screwed to door 2, as shown in FIG. 3A.

Figure 3B:
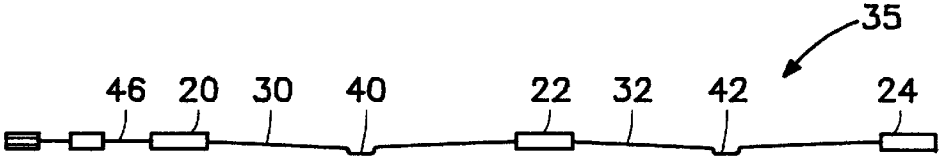
FIG. 3B is a side elevational view of a displacement mechanism of the first embodiment.

Channel 13 contains a displacement mechanism 35, which may have the form shown in FIG. 3B. The mechanism includes slide blocks 20 and 22 which are held in channel 13 in a manner to be freely movable along the length of channel member 13. A fixed block 24 is affixed in a position in channel 13.

The displacement mechanism 35 further includes two elongated, resilient members, e.g. leaf springs, 30 and 32 connected between blocks 20, 22, and 24 so that members 30 and 32 alternate with blocks 20, 22 and 24. Each member 30 and 32 may initially be flat but is concave or dish-shaped after assembly into channel 13 and has a center portion 40 or 42.

Figure 3C:
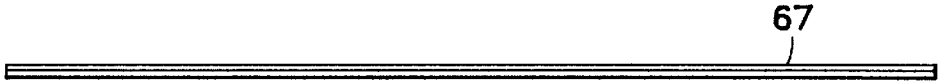
FIG. 3C is a side elevational view of a sealing strip forming part of a sealing member employed in embodiments of the invention.
Figure 3D:
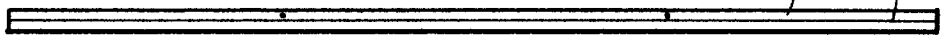
FIG. 3D is a side elevational view of a stiff or rigid component of the sealing member.
Figure 3E:
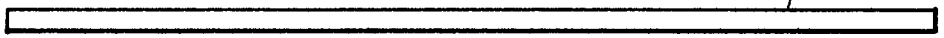
FIG. 3E is a side elevational view of a flexible sealing element of the sealing member.

Channel 13 also contains a sealing member which may be constructed as disclosed in U.S. Pat. No. 3,703,788. In the example shown in FIGS. 3C, 3D and 3E, the sealing member is freely mounted within the lower section of the channel and comprises a stiff, extruded H-shaped member 59, shown in FIG. 3D holding a flexible sealing element 61, shown in FIG. 3E. Member 59 is connected to center portions 40 and 42 by pivot pins, each of which may correspond to pin 63 in FIG. 4 of U.S. Pat. No. 3,703,788. H-shaped member 59 has two slots, one of which is visible at 65, formed on each outside edge portion for holding T-shaped sealing strips 67 shown in FIG. 3C.

Slide block 20 carries a pushrod 46 which will protrude beyond the hinge side of door 2 when the latter is open, as shown in FIG. 1. As door 2 is being closed, pushrod 46 contacts door jamb 4. Although a striker plate 55 may be mounted on door jamb 4 as a contact surface, the current embodiment preferably does not require the plate. The movement imparted to pushrod 46 by its contact with door jamb 4 as door 2 closes causes members 30 and 32 to displace so that center portions 40 and 42 move downwardly to lower the H-shaped member 59 to the sealing position in which the sealing element 61 contacts sill 8.

According to a novel feature of the invention, members 30 and 32 have dissimilar resistances to bending, i.e. spring constants, and member 30 has a lower resistance to bending than member 32 so that the end of the sealing member which is closest to the hinge end of channel member 13, i.e. the hinge side of door 2, will contact sill 8 before the remainder of the sealing member. After member 30 has been deformed to bring the associated end of the sealing member into contact with sill 8, pushrod 46 continues to be displaced by continued closing of door 2 to an extent sufficient to flex member 32 in order to move the remainder of the sealing member downwardly and into contact with sill 8.

The flexing movements of members 30 and 32 cause the ends of each member to move toward one another while the center portion 40 or 42 thereof moves downwardly.

Figures 4, 5, 6:
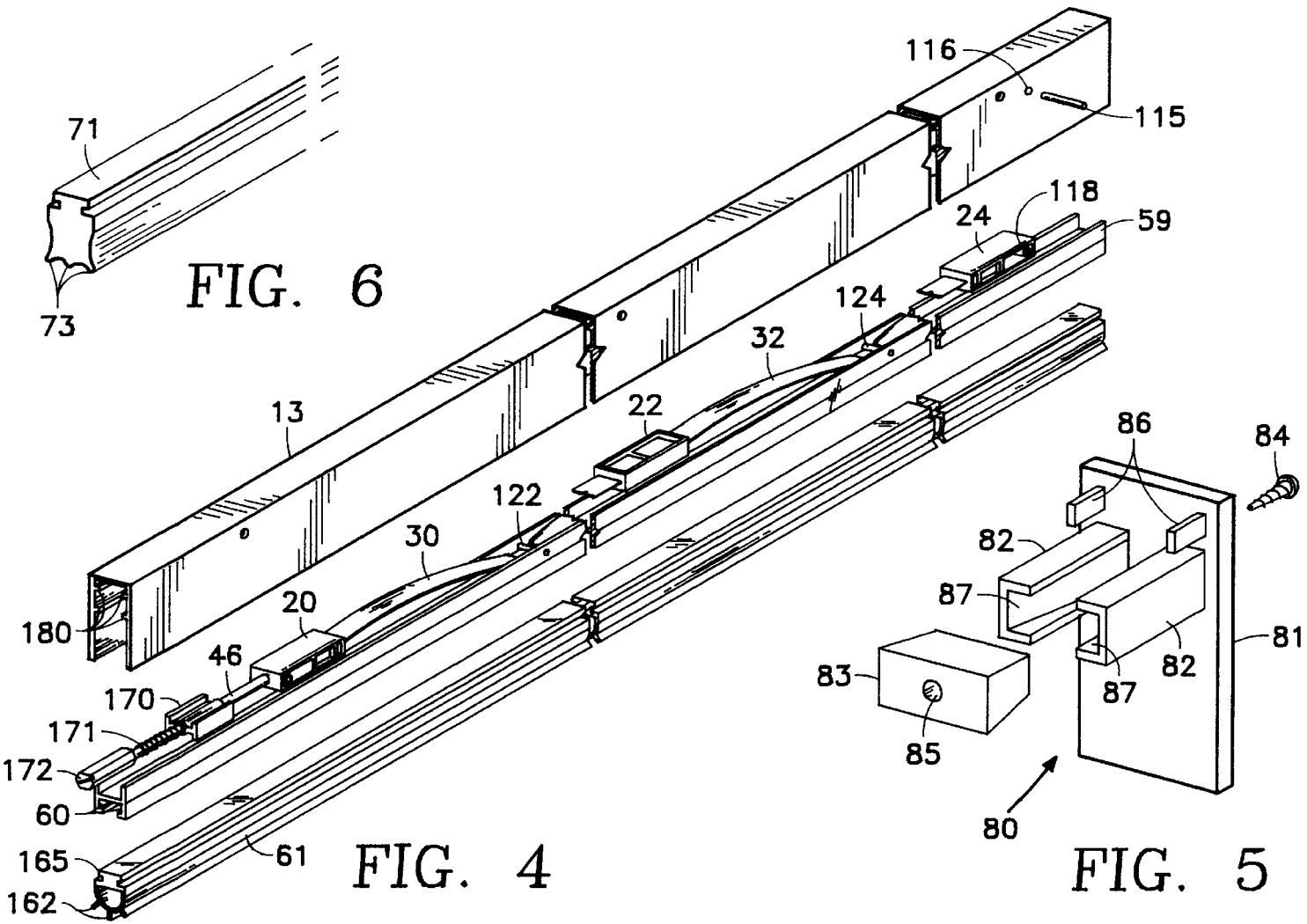
FIG. 4 is a perspective detail view of the first embodiment.
FIG. 5 is a perspective detail view of an endcap for the embodiment of FIG. 4.
FIG. 6 is a perspective detail view of an alternative form of a component of the embodiment of FIG. 4.

FIG. 4 is a partly exploded perspective view of the automatic door bottom shown in FIGS. 3A–E. The components within channel member 13 include a displacement mechanism composed of at least the two resilient members 30 and 32 although more than two members may be employed, as described below. Members 30 and 32 are interconnected by means of the slide blocks such as 20 and 22, although additional slide blocks will be provided if there are more than two resilient members. Further, fixed block 24 is affixed in position in channel member 13 by means of a pin 115 which extends through two aligned holes 116 in channel member 13 and a bore 118 in block 24.

The displacement mechanism 35 is completed by a rod assembly which includes a pushrod 46, a spacer block 170, a spring 171 and a cap nut 172 having a screw driver slot at its outer end. In the region to the left of spacer block 170, pushrod 46 is provided with a screw thread which threadedly engages with a mating thread within cap nut 172. Spring 171 is a compression spring which is coiled in a direction to act on cap nut 172 in the manner of a lock washer to prevent unintended rotation of cap nut 172 (rotation of the cap nut 172 axially moves cap nut 172 relative to spacer block 170).

Pushrod 46 is provided with radially projecting ears (not shown) which retain spacer block 170 in a desired position relative to rod 46.

The door bottom illustrated in FIG. 4 further includes the H-shaped member 59 which is here shown to be secured to the center portions of resilient members 30 and 34 by means of pivot pins 122 and 124 which extend through holes provided in member 59.

Member 59 is provided with an open channel 60 which holds a flexible, resiliently compressible sealing element 61 having, for example, three longitudinally extending, protruding strips, or ribs, 162 constituting points of contact with the associated door sill when a door carrying the door bottom is closed.

Sealing element 61 further includes an integral flange 165 by means of which the sealing element is held in the channel 60 formed in member 59. Sealing element 61 may be made of an extruded thermoplastic polymer, and particularly a thermoplastic rubber, preferably SANTOPRENE™ thermoplastic rubber.

Channel member 13 is provided interiorly with two pairs of ridges 180 which define a channel in which blocks 20 and 22, and block 170 are guided and in which block 24 is held. Member 59 and resilient member 61 are located below that channel.

The end of the channel member 13 that is opposite the hinge side of the door is sealed by means of an endcap 80 shown in FIG. 5. A plate 81 made of a semi-rigid plastic, for example glass-filled nylon, is provided with at least two flanges 82 adapted to fit into the channel defined by ridges 180 in channel member 13. The sides of the flanges 82 contacting the channel are parallel in an unstressed state and the opposed interior sides are tapered to receive a wedge 83 made of an engineering plastic, for example acetal. The flanges 82 support the plate 81 in channel member 13. Further, the interior sides of flanges 82 are provided with ledges 87 to receive and support the wedge 83. The wedge 83 and plate 81 are assembled by a fastening means 84, such as a self-threading screw, which is inserted through aligned holes 85. Additional flanges 86 cooperate with the channel formed above the ridges 180 to align plate 81 with channel member 13.

Initially, the plate 81 and wedge 83 are assembled such that the outwardly facing sides of flanges 82 are parallel and the endcap 80 is inserted into channel member 13. After insertion, additional force is applied to the fastening means 84, causing the wedge 83 to push outwardly on flanges 82, which causes the encap 80 to fit securely into channel member 13. Endcap 80 has the advantage that channel member 13 may be trimmed to fit doors of varying width and no hole or holes are required to be drilled in channel member 13 in order to insert and secure the endcap.

FIG. 6 is a perspective view illustrating an alternative sealing element 71 which may be employed in any of the previously described embodiments of the present invention. Sealing element 71 is a resiliently compressible, extruded closed cell sponge material, such as neoprene, for example. Sealing element 71 is provided with three longitudinally extending ribs 73 which perform the same function as strips 162 of sealing element 61.

Figure 7:
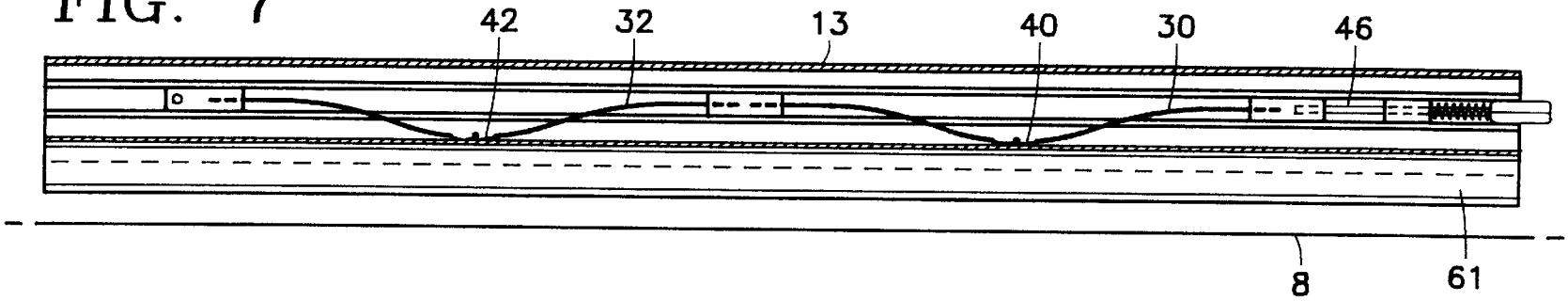
FIGS. 7, 8 and 9 are side elevational views showing the first embodiment of the invention in three successive operating stages.
Figure 8:
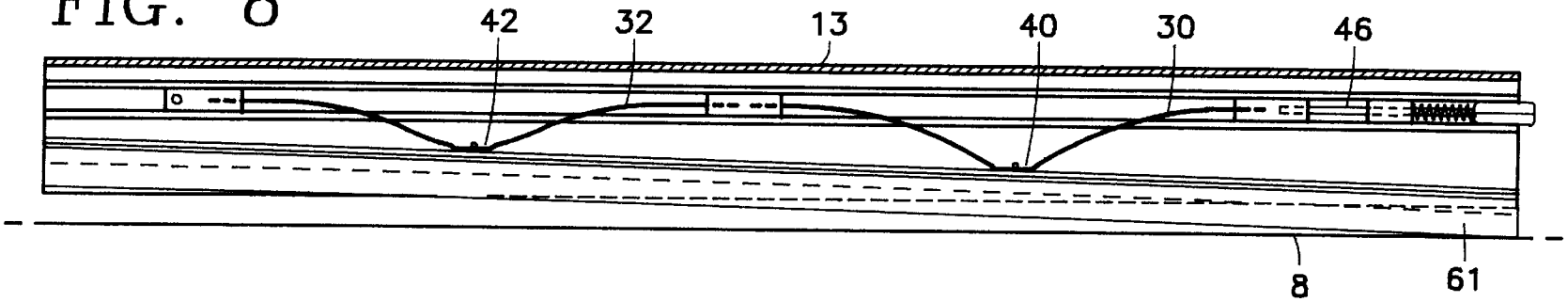
Figure 9:
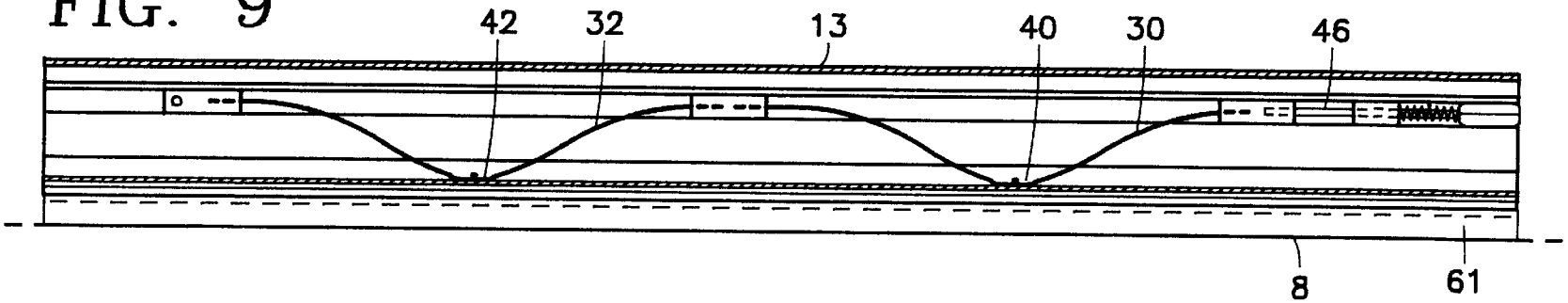

Successive points in the operation which occur during closing of door 2 are depicted in FIGS. 7, 8 and 9. FIG. 7 shows the condition of the automatic door bottom when door 2 is fully or partially open. Resilient members 30 and 32 are in an unstressed or slightly stressed state and sealing element 61 is partly retracted into the lower portion of channel member 13. The bottom surface of sealing element 61 is spaced vertically above sill 8, and preferably above the floor and any carpeting over which door 2 pivots. Pushrod 46 protrudes from the hinge side of door 2.

FIG. 8 shows the condition of the automatic door bottom as door 2 approaches its closed position. Pushrod 46 begins to be pushed in as a result of coming into contact with door jamb 4 or striker plate 55 (FIG. 1) and resilient member 30, because of its lower resistance to deformation, begins to flex first, moving center portion 40 downwardly until the end of element 61 at the hinge side of door 2 comes into contact with sill 8, door 2 at this time being a position where at least the hinge side thereof is above sill 8.

As door 2 continues to close, and since one end of element 61 is in contact with sill 8, resilient member 32 commences to flex, thereby moving center portion 42 downwardly until, as shown in FIG. 9, the entire length of element 61 contacts sill 8.

Preferably, pushrod 46 has a length sufficient to assure that sealing element 61 contacts sill 8 along its entire length. If pushrod 46 is slightly longer than necessary, its excess displacement will be absorbed by additional compression of element 61 and/or deformation of member 30 and possibly member 32.

Pushrod 46 may be made to have an adjustable length. This can be achieved with a variety of structures, including the one disclosed in U.S. Pat. No. 3,703,788.

Figure 10:
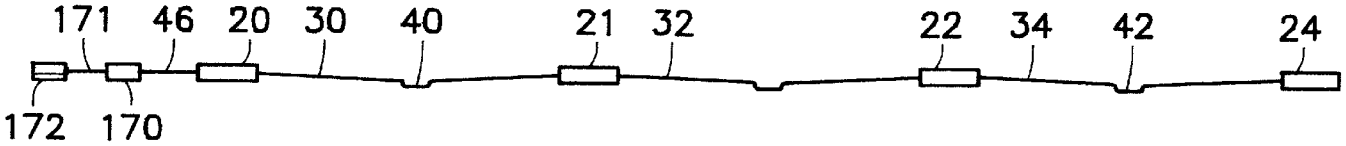
FIG. 10 is a side view of a displacement mechanism of an automatic door bottom according to a second embodiment.

The displacement mechanism 35 may have two or more resilient members. For example, FIG. 10 illustrates a displacement mechanism 35 with three resilient members 30, 32 and 34 separated by slide blocks 20, 21 and 22 and fixed block 24, according to another embodiment of the invention. When the displacement mechanism has three or more resilient members, the resilient members, such as 32 and 34, which are separated from the hinge side of door 2 by one resilient member, such as 30, may all have substantially the same resistance to bending, or progressively higher resistance to bending, or some variation thereof. For example, if there are four resilient members, the two intermediate ones may both have identical resistances to bending, while the outer resilient member remote from the hinge side of door 2 has a greater resistance to bending than the intermediate members.

Each resilient member may be made of spring steel and given the desired resistance to bending by an appropriate selection of one or more of width, thickness and material.

Figure 11:
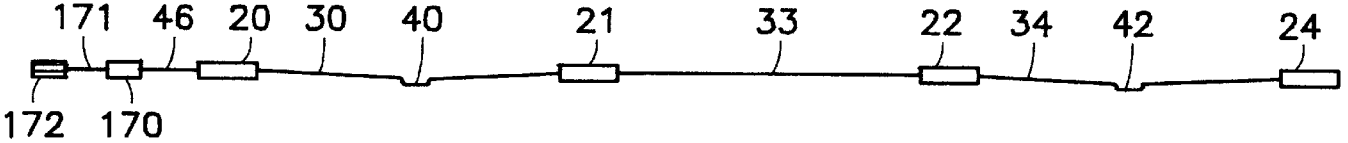
FIG. 11 is a side view of a displacement mechanism of an automatic door bottom according to a third embodiment.

In another embodiment, a rigid member is affixed between the resilient spring members for use with wider doors. As the width of the door increases, the horizontal displacement of the resilient members necessary to move the sealing member into a sealing position increases. In the case of wider doors, the amount of horizontal displacement needed to move the sealing member in to a sealing position exceeds the range of motion of the pushrod from a fully open to a closed position, and the adjustment range of the pushrod. FIG. 11 is a side view of this embodiment illustrating the rigid member 33 connected by means of slide blocks 21 and 22 between two resilient members 30 and 32. This embodiment also has the advantage of operating the automatic door bottom with wider doors without increasing the actuating force.

Figure 12:
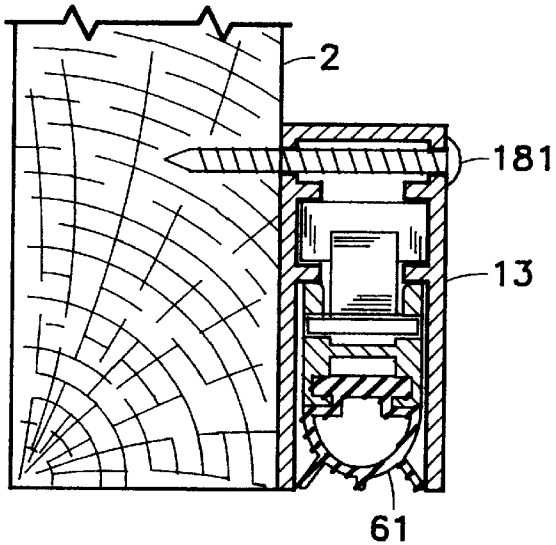
FIGS. 12 and 13 are elevational, cross-sectional views illustrating respective installations of the embodiment of FIG. 4.

FIG. 12 is a cross-sectional view illustrating the embodiment of FIG. 4 surface-mounted at the bottom of a major surface of door 2. The bottom edge of channel member 13 is flush with the bottom edge of door 2. Normally, a door bottom according to the present invention would be mounted on the surface of door 2 which opens inwardly. The automatic door bottom is shown in the state in which resilient member 61 is retracted into channel member 13. The door bottom is secured to door 2 by a plurality of wood screws 181.

Figure 13:
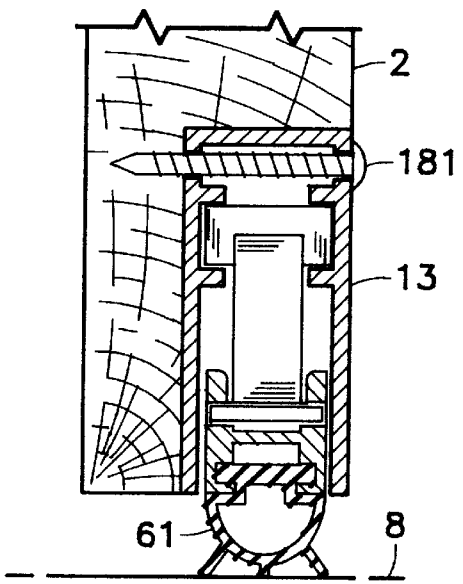

FIG. 13 shows the embodiment of FIG. 4 installed in a semi-mortise which has been cut into door 2 in the region of its bottom edge. The automatic door bottom is here shown in its state in which resilient member 61 has been displaced downwardly to contact an associated door sill.

Figure 14:
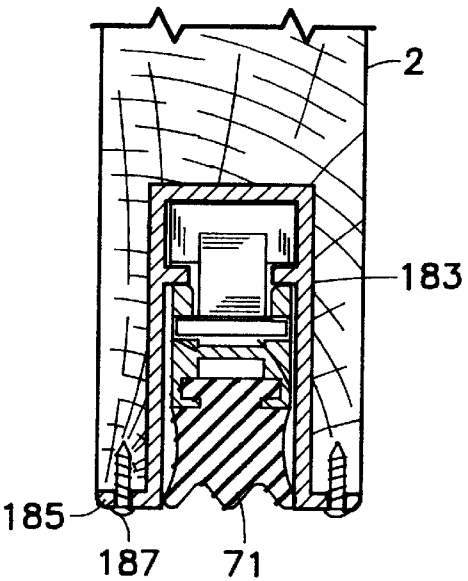
FIG. 14 is a view similar to that of FIGS. 12 and 13 illustrating a modified version of the embodiment of FIG. 4 installed in the bottom of a door.

FIG. 14 shows a modified version of the embodiment of FIG. 4 installed in a full-mortise formed in the bottom edge of door 2. This embodiment of the automatic door bottom differs from that shown in FIG. 4 in that it includes a channel member 183 having a portion in the form of an inverted U and two horizontally extending flanges 185 which bear against the bottom edge of door 2. In this embodiment, the automatic door bottom is secured in place by means of a plurality of wood screws 187 spaced apart along the length of each flange 185.

In addition, the embodiment shown in FIG. 14 differs from that of FIG. 4 in that it is provided with the sealing element 71 of FIG. 6.

An additional advantage provided by automatic door bottoms according to the present invention is that they require lower operating forces to operate the automatic door bottom. First, an initial force is needed to begin flexing the resilient members from their unstressed or slightly stressed state. This initial force resisting the operator can be defined as an actuating force and is produced by the provision of a plurality of resilient members, such as 30, 32 and 34, in place of the single resilient member known in the art. Since one of resilient members, for example 30, has a lower resistance to bending than others of the resilient members or the single resilient member known in the art, the actuating force for the present invention is lower.

The present invention also requires a lower force to close the door and complete the sealing operation. This force can be defined as a closure force and is related to the force necessary to overcome the resistance caused by the sealing element 61 contacting the door sill 8 or floor covering during closure. This closure force is distinct from the actuating force, as described previously. The closure force increases as the length of the sealing element 61 contacting the sill 8 or floor covering increases during the closing operation. Since the present invention has an object to prevent the major portion of the sealing member from contacting the sill 8 until immediately before completion of the door closing, the present invention presents a lower resistance to door closure. The portion of the sealing element 61 contacting the sill 8 or floor covering at any time comprises a lever arm acting about the axis of rotation of the door hinges 6. As the length of this lever arm decreases, the rotational force needed to overcome this resistance force, or closure force, decreases. The present invention provides a smaller lever arm during nearly all of the door closing operation and, therefore, a lower closure force. This reduced force during door closure also results in the advantage that less work is expended in closing the door.

In addition, the sealing elements 61 and 71 illustrated in FIGS. 4 and 6 further contribute to creation of a low actuating force because the hollow structure of sealing element 61 and the closed cell sponge composition of sealing element 71 have reduced resistance to deformation and because strips 162 of sealing element 61 and ribs 73 of sealing element 71 provide an improved seal even when applied against a door sill with a low level of force.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. An automatic door bottom for a hinged door which is pivotable to be positioned over a sill when closed, the door having a hinge side and a width, said door bottom comprising:

a sealing member having a length corresponding to the width of the door bottom;

an actuator responsive to closing of the door for moving said sealing member vertically downward into a sealing position relative to the sill when the door is closed beginning with the hinge side of the door;

said actuator comprising a plurality of elongated resilient members spaced along the width of said door bottom having a first plurality of elements in sliding abutment against said sealing member and a second plurality of elements in sliding abutment toward said door;

one of said resilient members being closest to said hinge side of said door, each of said resilient members having a resistance to bending, and said one of said resilient members having a lower resistance to bending than each other one of said resilient members.

2. A door bottom as defined in claim 1 wherein one other of said resilient members with the greatest resistance to bending is disposed adjacent a side of said door opposite to the hinge side.

3. A door bottom as defined in claim 1 wherein said actuator further comprises a channel positionable adjacent the bottom of the door and wherein each of said first plurality of elements comprises a slide block slidable along the length of said channel and connected between adjacent ones of said resilient members.

4. A door bottom as defined in claim 1 wherein said actuator further comprises a rigid member connected between two of said resilient members.

5. A door bottom as defined in claim 1 wherein said actuator further comprises a channel having a hinge end and a pushrod projecting from said hinge end of said channel, said pushrod being displaceable by engagement with a door jamb when the door is closed to effect bending of said resilient members.

6. An automatic door bottom for a hinged door which is pivotable to be positioned over a sill when closed, the door having a hinge side and a width, said door bottom comprising:

a sealing member having a length corresponding to the width of said door bottom;

a movable member positionable to be actuated by the closing of the door;

a plurality of springs positonable adjacent the bottom of the door and coupled to said movable member having a first plurality of elements in sliding abutment against said sealing member and a second plurality of elements in sliding abutment toward said door so that said plurality of springs flex and engage said sealing member as said movable member is actuated thereby to cause said sealing member to move into a sealing position relative to the sill when the door is closed; and wherein each of said plurality of springs has a resistance to flexing and wherein a first spring of said plurality of springs closest to the hinge side of the door has a lower resistance to flexing than each other one of said plurality of springs.

7. A door bottom as defined in claim 6, further comprising a rigid member connected between two of said plurality of springs.

8. A door bottom as defined in claim 6 further comprising a channel positioned adjacent the bottom of the door and a slide block slidable along the length of said channel and connected between two of said springs.

9. A door bottom as defined in claim 8 wherein said movable member comprises a pushrod projecting from the hinge end of said channel, said pushrod engageable with a jamb of the door so as to be displaced when the door is closed to effect flexing of said springs.

10. An automatic door bottom for a hinged door which is pivotable to be positioned over a sill when closed, the door having a hinge side and a width, said door bottom comprising:

a case having an inverted channel having an open bottom, a length corresponding to the door bottom width and a hinge end corresponding to the hinge side of the door;

a sealing member having a length corresponding to the length of said channel, said sealing member being housed in said channel and being movable vertically downwardly into a sealing position in which said sealing member is positionable so that it will contact the sill when the door is closed;

a displacement mechanism comprising plural resilient members of different spring stiffnesses installed in said channel and coupled to said sealing member for moving said sealing member into the sealing position in response to closing of the door, wherein said displacement mechanism is slidably coupled to said sealing member at a first plurality of points along the length of said sealing member and slidably coupled toward said door at a second plurality of points along the length thereof and is operative to move the end of said sealing member at said hinge side of said channel into the sealing position prior to the remainder of said sealing member during closing of the door.

11. A door bottom as defined in claim 10 wherein said displacement mechanism further comprises a slide block slidable along the length of said channel and connected between two of said resilient members.

12. A door bottom as defined in claim 10 wherein said displacement mechanism further comprises a rigid member connected between two of said resilient members.

13. A door bottom as defined in claim 10 wherein said displacement mechanism further comprises a pushrod projecting from said hinge end of said channel, said pushrod being displaceable by engagement with a door jamb when the door is closed to effect bending of said resilient members.

14. A door bottom as defined in claim 10 wherein each said resilient member comprises a strip of spring material having opposed ends and connected at a point between said opposed ends to said sealing element.

15. A door bottom as defined in claim 10 therein each said resilient member is a strip of spring material having opposed ends to said sealing element.

16. A door bottom as defined in claim 15 wherein said displacement mechanism further comprises a rigid member connected between said opposed ends of two of said resilient members.

17. A door bottom as defined in claim 10 wherein said displacement mechanism further comprises a slide block slidable along the length of said channel and connected between two of said resilient members.

18. A door bottom as defined in claim 10 wherein said displacement mechanism further comprises a pushrod projecting from said hinge end of said channel, said pushrod being displaceable by engagement with a door jamb when the door is closed to effect bending of said resilient members.

19. A door bottom as defined in claim 10 wherein each said resilient member is a strip of spring material having opposed ends and connected at a point between said opposed ends to said sealing element.

20. A door bottom as defined in claim 19 further comprising a rigid member connected between said opposed ends of two of said resilient members.

21. A door bottom as defined in claim 10 wherein said sealing member comprises a compressible body having a plurality of generally downwardly facing protruding ribs for contacting a sill when said sealing member is in the sealing position.

22. A door bottom as defined in claim 21 wherein said sealing member is constituted by a resiliently compressible closed cell sponge material.

23. A door bottom as defined in claim 10 wherein said case defining an inverted channel consists of a channel member having an inverted U-shaped form.

24. A door bottom as defined in claim 23 wherein said channel member is symmetrical about a vertical median plane that extends along the length of said inverted channel.

25. A door bottom as defined in claim 10 wherein the resistances to bending of said resilient members progressively increases from the hinge side of said door to a distal side of said door so as to lastly engage a distal side of said sealing member upon closure of said door, whereby to minimize the closing force for said door.

26. A door bottom as defined in claim 10 further comprising an endcap for sealing the end of said channel opposite the hinge end.

27. A door bottom as defined in claim 26 wherein said endcap comprises a plate provided with an aperture and opposed flexible flanges with tapered interior sides and exterior sides adapted to slide into said channel;

a wedge provided with an aperture and sides adapted to engage said tapered interior sides to expand said flanges in said channel; and fastening means adapted to engage said apertures for expanding said flanges in said channel.

* * * * *